US005895042A

United States Patent [19]

Allmendinger et al.

[11] Patent Number: 5,895,042

[45] Date of Patent: Apr. 20, 1999

[54] APPARATUS FOR STACKING AND ALIGNING INDIVIDUAL SHEETS

[75] Inventors: Franz Allmendinger, Aichwald; Volker Koenig, Ebersbach; Peter Schmidt, Geislingen, all of Germany

[73] Assignee: Eastman Kodak Company, Rochester, N.Y.

[21] Appl. No.: 08/881,170

[22] Filed: Jun. 24, 1997

[30] Foreign Application Priority Data

Jul. 2, 1996 [DE] Germany ..... 196 26 577

[51] Int. Cl.[6] ..... B65H 9/04

[52] U.S. Cl. ..... 271/245; 271/236; 271/254; 271/189; 271/213; 414/790.8

[58] Field of Search ..... 271/189, 213, 271/236, 245, 253–255; 414/790.5, 790.8

[56] References Cited

U.S. PATENT DOCUMENTS

| | | | |
|---|---|---|---|
| 4,456,239 | 6/1984 | Yamaguchi | 271/189 X |
| 5,007,797 | 4/1991 | Munz . | |
| 5,014,977 | 5/1991 | Moore et al. . | |
| 5,697,605 | 12/1997 | Pollich et al. | 271/189 |

FOREIGN PATENT DOCUMENTS 444110 11/1989 European Pat. Off. .

*Primary Examiner*—Boris Milef
*Attorney, Agent, or Firm*—Lawrence P. Kessler

[57] ABSTRACT

A carrier (2) of an apparatus (1) is pivotably mounted on a shaft (6) and can be moved by means of a stepper motor (34) via a cable (40). Apparatus (1) is positioned above tray surface (29) of storage container (28) and has a motor-driven impeller (27) and motor-driven separating fingers (25, 26). Driving motors (7 and 13, respectively) and their appropriate drawing means (12 and 20, 24 respectively) for impeller (27) and for separating fingers (25, 26) respectively are arranged on carrier (2). The sheets are individually arranged on top of one another to form a stack on tray surface (29) and are aligned by impeller (27) on front stopping edge (41), while separating fingers (25, 26) serve to temporarily retain subsequently arriving sheets as long as the finished stack of sheets still lies on tray surface (29). Apparatus (1) is guided via a device for measuring the height of the stack of sheets into a position with respect to the upper side of the stack such that impeller (27) and separating fingers (25, 26) are always correctly positioned for operation with respect to the upper side of the stack whatever the height of the stack. The apparatus can also be moved by stepper motor (24) into raised positions regardless of the height of the stack of sheets.

11 Claims, 3 Drawing Sheets

APPARATUS FOR STACKING AND ALIGNING INDIVIDUAL SHEETS

BACKGROUND OF THE INVENTION

The invention relates to an apparatus for stacking and aligning sheets fed individually into a storage container where they are collected in a pile. The storage container of the apparatus has a tray surface with a front stopping edge for aligning the sheets, and a retaining mechanism placed in the area of the front edges of the tray surface and located above the sheets to be stacked. The retaining mechanism has pivotable separating elements, is that when the stack of sheets is complete, these elements are temporarily swung into the path of the sheets still being fed into the storage container.

In an apparatus known from U.S. Pat. No. 5,007,797, sheets are fed into a storage container where they can be temporarily held back by a retaining mechanism with pivotable separating fingers in such a way that the stack of sheets already deposited can be stapled and/or removed. The separating fingers, which can be swung onto the top surface of the finished stack of sheets, are locked into position thereby limiting the holding capacity of the tray surface.

In another apparatus for stacking sheets (U.S. Pat. No. 5,014,977), the sheets are aligned at a front stopping edge by an aligning device in the form of an impeller which acts on the top surface of the stack of sheets. The impeller of this apparatus is mounted at the free end of a pivotably arranged carrier which is balanced out by means of a spring and counterweight thereby ensuring that the carrier can swing upwards as the stack of sheets grows in size.

SUMMARY OF THE INVENTION

It is the object of the present invention to provide the above-described type of apparatus for stacking and aligning sheets with a mechanism so that both the aligning device for the arriving sheets as well as the retaining device for the subsequently incoming sheets can be reliably brought into an operational position.

This is achieved in accordance with the present invention;

- in that the retaining device and an aligning means for arranging the sheets at the front stopping edge are positioned on a common carrier which is vertically adjustable with respect to the surface of the tray,
- in that the carrier can be moved by a motor-driven adjusting mechanism,
- in that the vertical adjustment of the carrier depends on the height of the stack of sheets and
- in that the aligning device and the retaining device can be moved by the adjusting mechanism into a position dependent on the particular height of the stack of sheets and operational with respect to the upper side of the stack.

This is further achieved in accordance with the present invention

- in that the retaining mechanism and the aligning device for bringing the sheets to the front stopping edge are both arranged on a common carrier which is vertically adjustable with respect to the surface of the tray,
- in that the carrier can be moved by means of a motor-driven adjusting mechanism and
- in that the aligning means and the retaining device can be moved by the adjusting mechanism into at least one position located above the maximum height of the stack of sheets.

The arrangement as disclosed in accordance with the present invention in which the aligning device and the retaining device are positioned on a common, vertically adjustable carrier has the advantage that the position of the aligning device and of the retaining device is automatically adjustable, said position being dependent on the height of the stack of sheets and being functionally appropriate with respect to the upper side of the stack of sheets. The adjustment of the carrier is preferably performed by means of an elevating mechanism operated by a stepper motor which is controlled by a sensor measuring the height of the stack of sheets. The motor-driven devices both for the aligning means as well as for the retaining device are also advantageously arranged on the carrier so as to constitute a simple and compact unit. Additional features and advantages can be seen from the description of an example of an embodiment of the invention as shown in the drawing, and from the subclaims.

BRIEF DESCRIPTION OF THE DRAWINGS

The drawing is a schematic representation wherein.

Figure 1:
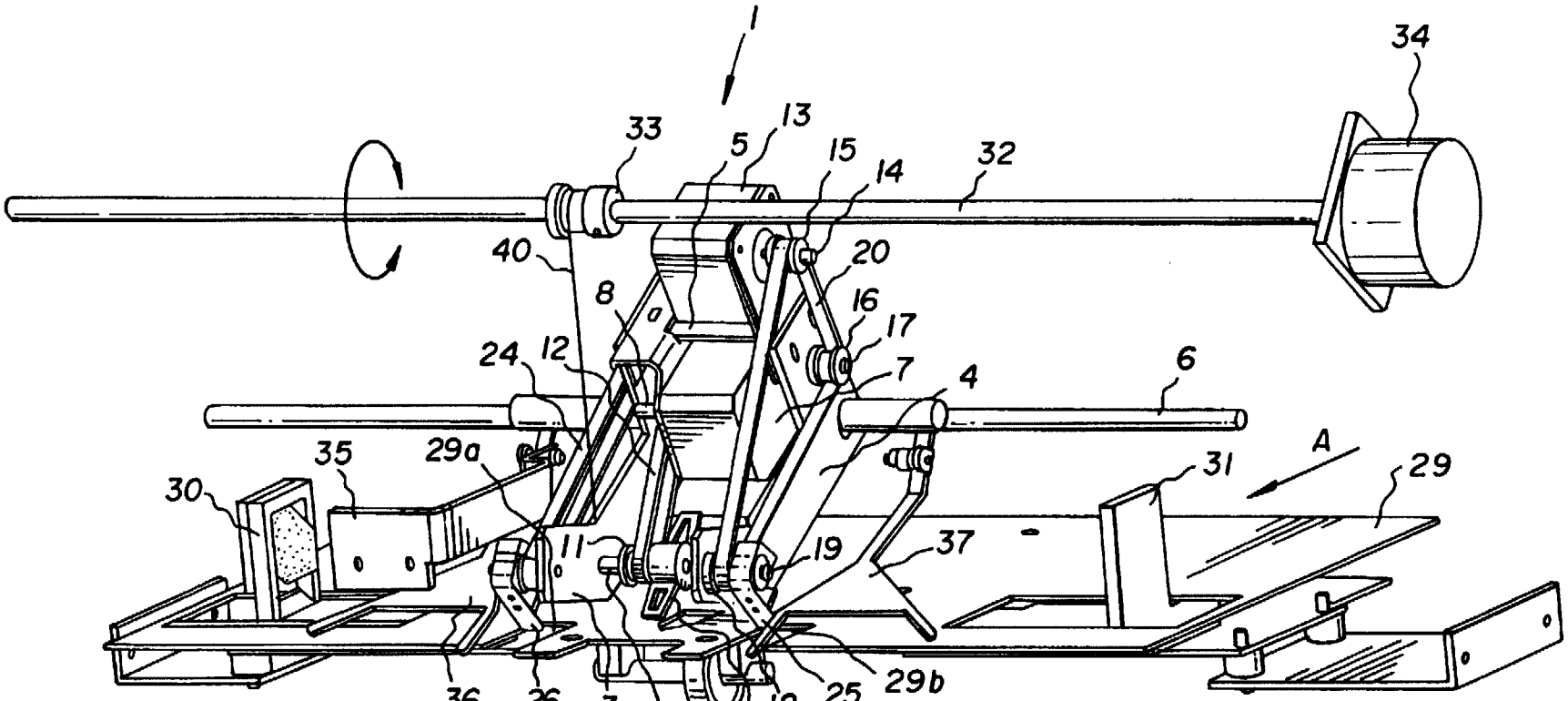
FIG. 1 depicts the apparatus in an oblique view without the stapling device.

The apparatus in accordance with the present invention is attached to the copy feeding device of a further processing device into which sheets are fed from a known type of copier (not shown), the sheets then being collected in a stack in a storage container and thereafter stapled in sets by means of staples. The collected set of sheets, either stapled together or not stapled, is then removed from the storage container by means of a gripping mechanism (not illustrated) and passed on to a holding station. Aligning and retaining device 1 in accordance with the present invention is part of such a further processing device, only those components thereof being shown which are necessary to understand the present invention. A further processing device of this kind is known, for example, from EP Patent 444,1 0.

Aligning and retaining apparatus 1, called apparatus for short in the following, is pivotably mounted as a complete unit on shaft 6 and is controllable by means of elevating mechanism 32, 33, 34 and 40 whose mode of operation will be later described. Apparatus 1 is attached to storage container 28 and arranged above tray surface 29 which slopes downwards at a sharp angle $\alpha$ of about 40° with respect to transport direction "A".

Apparatus 1 has a carrier 2 having two like arms 3 and 4 arranged at a distance and parallel to each other and which are rigidly connected to one another by means of a U-shaped portion 5. Arms 3 and 4 are pivotably mounted on shaft 6 at the end where they are connected to one another by part 5, while an aligning and retaining means 25, 26 and 27 (to be later described) are rotatably mounted at their other free end.

Motors 7 and 13 arranged between arms 3 and 4 are mounted in the pivot area neighboring on shaft 6 of carrier 2. Motors 7 drives a known type of impeller 27 with flexible impeller wings, this impeller being rotatably mounted on shaft 10 which is attached to the free end of arms 3 and 4. A drive wheel 11 is fastened to shaft 10, the drive wheel being driven by traction device 12 which engages with drive wheel 9 attached to shaft 8 of motor 7.

Motor 13, which is designed as a stepper motor, drives two separating fingers 25 and 26, respectively, which serve, in a manner to be later described, as a retaining means. Separating fingers 25 and 26, respectively, are fastened to drive wheels 18 and 22, which are pivotably mounted on pivots 19 and 23, respectively. The pivots are fastened to the free end of arms 3 and 4, respectively and to their outer side. Drive wheels 18 and 22, respectively are moved by traction mechanism 20 and 24, which act on drive wheels 16 and 21, respectively. The drive wheels being fastened to rotatably mounted axis 17 which is arranged parallel to shaft 6 and which passes through carrier 2. The traction mechanism 20 also moves drive wheel 15 fastened to drive shaft 14 of motor 13, such drive wheel 15 moving both separating fingers 26 and 27 via the traction mechanism 20 and carrier-penetrating axis 17.

The elevating mechanism for apparatus 1 is positioned above storage container 28, such elevator having a locally fixed and rotatable shaft 32 which is driven by stepper motor 34. Connected to shaft 32 is a mandrel 33 which is attached to one end of a cable 40, the other end of which is attached to arm 3 of carrier 2.

Apparatus 1 also has other components and units necessary for producing sets of sheets. Thus, side stopping edges 30 and 31, adjustable to the format of a copy, are provided on tray surface 29 of storage container 28, stopping edge 30 being provided with downward facing brushes which make it possible to compensate for different paper tolerances and which simultaneously effect exact edge-to edge alignment of the sheets to smooth stopping edge 31 located on the opposite side of tray surface 29.

Figure 2:
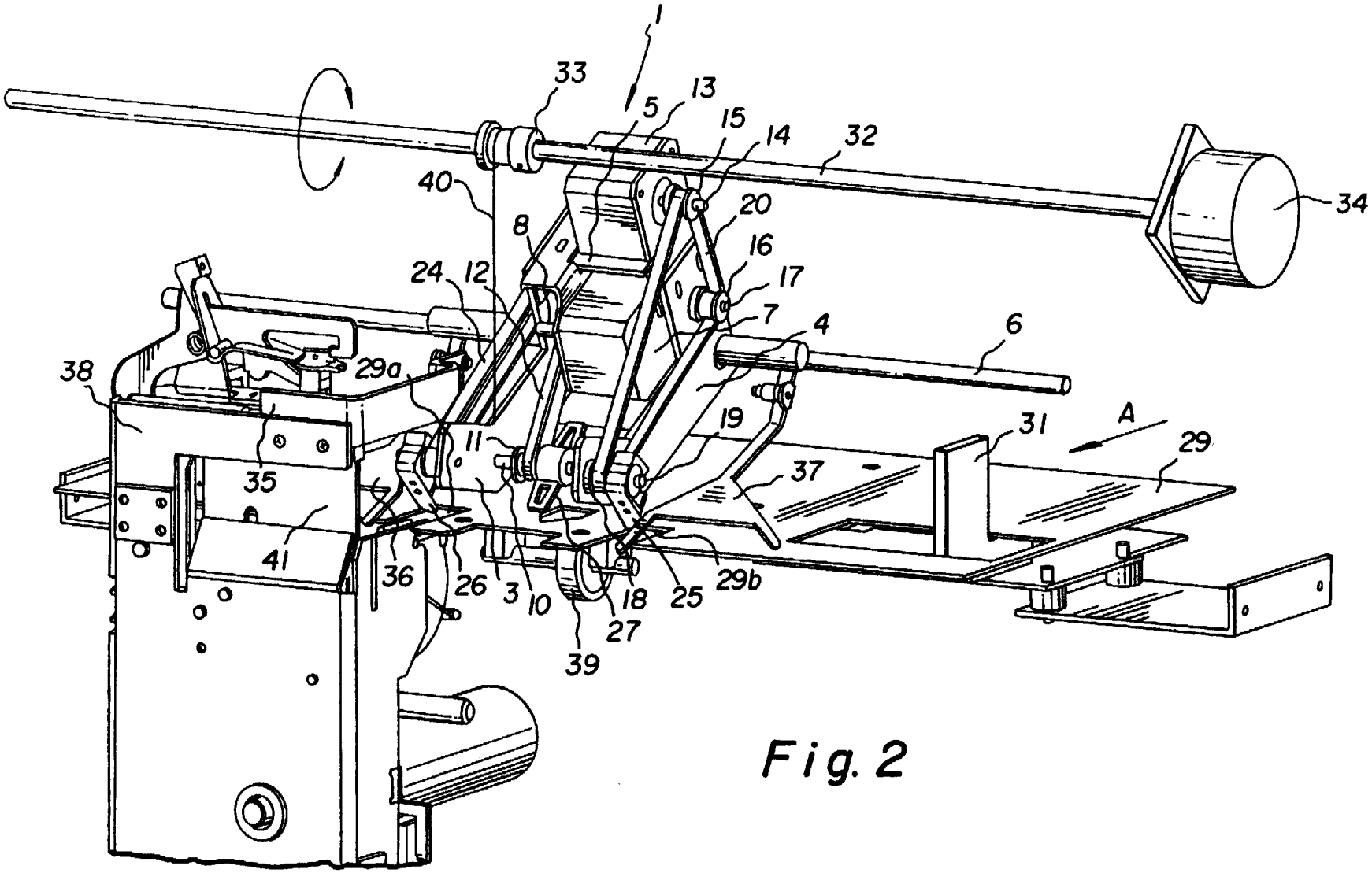
FIG. 2 shows the apparatus according to FIG. 1, with the stapling device.
Figure 3:
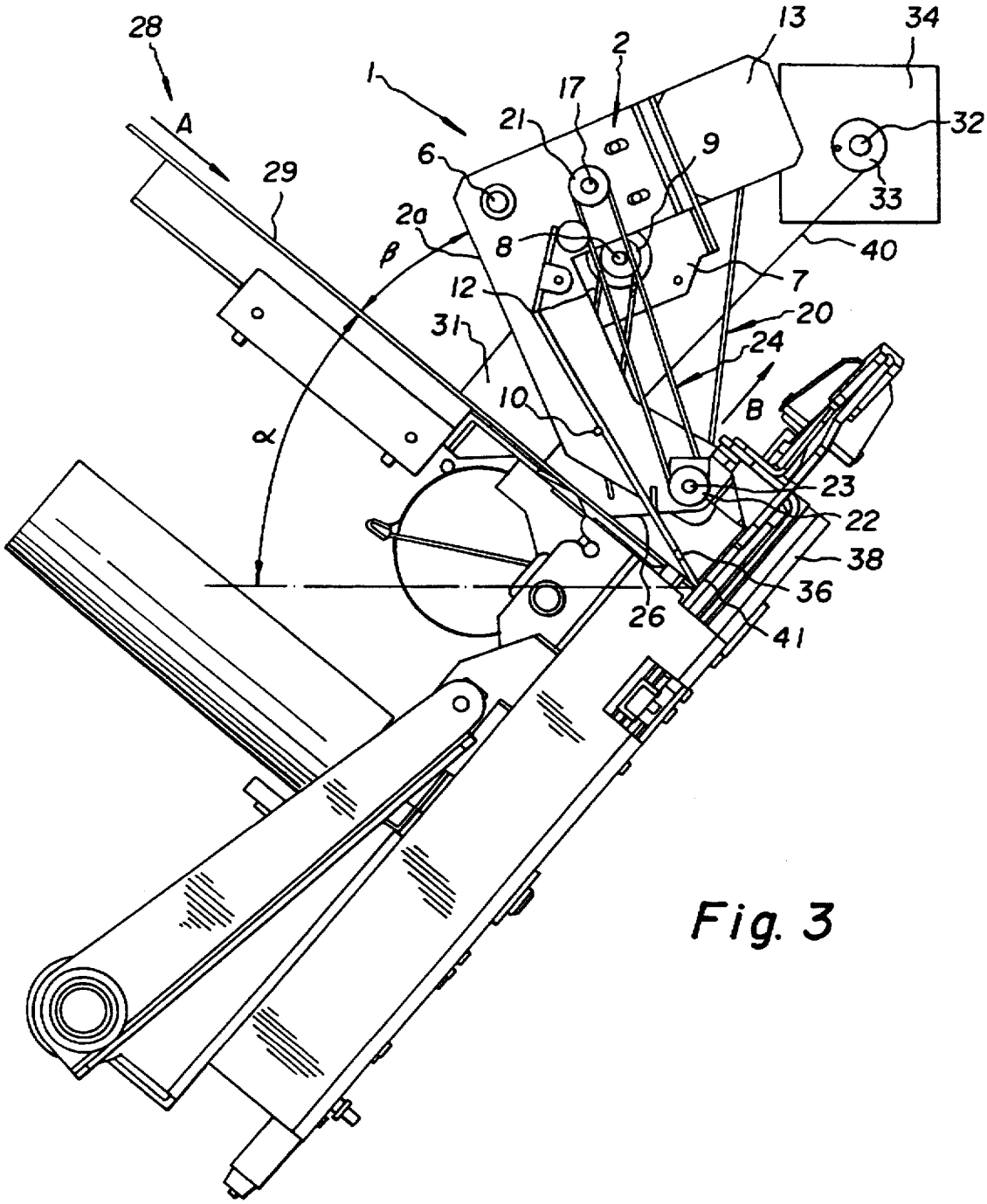
FIG. 3 is a side view of the apparatus according to FIG. 2, in the sloping position, i.e. operational position.

In addition, as partially shown in FIGS. 2 and 3, stapling devices 38 are arranged at the lower end of storage container 28, such stapling devices protruding sideways into the storage area in such a way that a complete set of sheets moving in the direction of arrow "A" can pass by the stapling devices 38. Stapling devices 38, of which one is positioned to the left and to the right, respectively of apparatus 1 are provided with front stopping edges 41 movable in the downward direction (see FIGS. 2 and 3). (For the sake of greater clarity, stapling devices 38 are not depicted in FIG. 1 and, for the same reason, units 1 and 28 are shown in their entirety rotated into a horizontal position with respect to tray surface 29: in FIG. 2, which corresponds to FIG. 1, one of two stapling devices is partially illustrated). The front stopping edges 41 serve to align the front edges of the sheets or to release a complete set of sheets. Stapling devices 38 can be adjusted to different stapling positions perpendicular to the copy transport direction "A". The stapling devices 38 are provided with holding down arrangements 36 and 37, respectively which are pivotably attached to stapling devices 38 by means of clamps 35 (which are omitted in FIG. 3, and only one of which is illustrated in FIGS. 1 and 2).

The apparatus works in the following way: Referring to FIG. 1, the sheets entering storage container 28 are center-oriented, stacked and aligned. To this end, apparatus 1 is arranged perpendicularly to transport direction "A" in a fixed position, whilst side stopping edges 30 and 31 can be symmetrically adjusted with respect to the center axis of the path of paper in order to take the format of the paper into consideration. In addition, side stopping edges 30 and 31 can be moved back and forth by well-known motor driven means (not shown), so that each copy entering the apparatus is center-oriented and aligned by means of the double motion of stopping edges 30 and 31. Exact edge-to-edge alignment of the collected sheets is achieved in that side stopping edge 31 has a smooth surface to which the sheets are brought by the opposite, brush-like stopping edge 30, the edge 30 being able to compensate for slight variations in the size of the sheets.

When storage container 28 is empty, apparatus 1 assumes a lower starting position (shown in FIG. 3) into which it was brought by elevator 32, 33, 34 and 40. The leading edge of a copy delivered in the direction of a row "A" by means of well-known transport rollers (not illustrated) of the apparatus either hits guide surface **2*a* formed by the lower side of arms 3 and 4 of carrier 2, or it hits a fixed guide element (not depicted) provided as an extension to the apparatus and is then guided in the direction of arrow "A" to front stopping edge 41. Guide surface 2*a* together with its guide element face in a downward direction at a sharp angle $\beta$ of about 30° with respect to tray surface 29** and the direction of arrow "A".

After the trailing edge of the incoming copy is released by the transport rollers of the apparatus, it glides downwards in the direction of arrow "A" due to gravity. During this time the copy is center-oriented and aligned by side stopping edges 30 and 31 as already described, and enters the radius of action of counterclockwise rotating impeller 27 which brings the copy to front stopping edge 41. In the vicinity of front stopping edge 41, the leading edge of the copy comes under holding down arrangements 36 and 37, these lying on the aligned copy due to the action of gravity. The flexible impeller arms of continuously driven impeller 27 glide elastically over the previously aligned copy.

The following sheets are stacked and aligned in the same way, the emergence of the sheets above tray surface 29 from the transport rollers of the apparatus occurring at such distances that the next copy can glide smoothly onto the copy already stacked. During the stacking of a set of sheets, separating fingers 25 and 26 assume an initial position (not shown), i.e. they lie above the upper side of the stack of sheets and outside the path of the sheets. Stepper motor 34 of the elevator is regulated by the growing height of the stack of sheets. For this purpose, a sensor of a well-known type (not shown) is provided which scans the upper side of the stack of sheets and which, at certain intervals, delivers a corresponding control signal to the stepper motor 34, for example, each time ten sheets have been stacked. At the same time, the sensor can also be used in a known manner to measure the maximum height of a stack which can be stapled. The sensor-controlled scanning of the upper side of the stack of sheets effects that after ten sheets have been stacked, stepper motor 34 raises carrier 2 of apparatus 1 via cable 40 by 1 mm in the direction of arrow "B".

The elevation of apparatus 1 which is regulated by the height of the stack of sheets guarantees that regardless of the number of sheets to be stacked, impeller 27 and separating fingers 25 and 26 always assume the correct position for operation with respect to the upper side of the stack of sheets. This ensures that within the possibilities offered by the apparatus, a stack of sheets of any desired height can be stacked, and that apparatus 1 will always work reliably and handle the sheets with care.

As soon as a well-known type of counting device (not illustrated) has determined that a complete stack of sheets has been introduced into storage container 28, then separating fingers 25 and 26 are lowered onto the upper side of the stack. This takes place as follows: stepper motor 13 rotates axis 17 in the counterclockwise direction until an angle is reached where separating fingers 25 and 26 assume the position (shown in FIGS. 1 to 3) in which they lie on the upper side of the complete stack of sheets, and in which they form a sloping surface for the following copy belonging to the next stack.

The next copy entering storage container 28 is thus separated from the stack underneath it and is pushed up the sloping surface of separating fingers 25 and 26, respectively where it comes to rest. All following sheets will always enter storage container 28 from above the stack of sheets and will be caught in the same way as the copy already inverted by separating fingers 25 and 26.

The collected and complete stack of sheets is stapled together by stapling device 38. Once stapling has been finished, separating fingers 25 and 26 return to an intermediate position (not shown) which is just slightly above the stack of sheets so that the stapled stack of sheets can be removed without hindrance. The separating fingers are lifted into the intermediate position by means of a stepper motor 13 which rotates axis 17 for this purpose in the clockwise direction until separating fingers 25, 26 assume the intermediate position in which subsequently arriving sheets continue to be caught in the above-described manner. During this time, carrier 2 remains in the position last assumed.

After completion of the stapling procedure, front stopping edges 41 are moved downwards and out of the path of movement of the stack of sheets by means of a well-known type of electromagnetic device (not depicted) so that the stapled stack of sheets can be removed in the direction of arrow "A". This removal is preferably performed by a well-known type of gripping device (not shown) which places the stacks of sheets on top of one another on a tray (not depicted) located under storage container 28 and within the further processing device. The transportation of the complete stack of sheets out of the system is assisted by a transport wheel 39 which is arranged below and which protrudes into tray surface 29; it is set in motion whenever a stack of sheets is removed.

After the stapled stack of sheets has been removed from storage container 28, front stopping edges 41 are moved back into their upper closed position. In this upper closed position, a signal is generated which causes stepper motor 34 to return carrier 2 into its lower initial position. Thereafter, stepper motor 34 rotates axis 17 in the counterclockwise direction as a result of which separating fingers 25 and 26 leave their raised intermediate position and swing counterclockwise thereby transferring the sheets (for example, three sheets) lying on separating fingers 25, 26 to the now empty tray surface 29 of storage container 28.

Separating fingers 25, 26 swing ahead of the sheets in the same direction: they then horizontally pass by stapling devices 38. Tray surface 29 is provided with gaps **29*a*, 29*b* which permit free passage of separating fingers 26, 26. Separating fingers 25, 26 continue to swing until they reach their initial position (not shown) in which they are positioned above tray surface 29 and outside the path of movement of the sheets being stacked. The sheets being released by separating fingers 25, 26 are moved at their upper side by impeller 27, which continuously rotates in the same direction, and at their underside by transport wheel 39, until they reach front stopping edges 41. Transport wheel 39 is brought to a stop again after a predetermined time interval, during which the sheets are brought to front stopping edges 41** and aligned.

In the same manner as already described in the aforegoing, the sheets released by separating fingers 25, 26 and the following sheets are center-oriented and aligned by side stopping edges 30 and 31 and delivered to front stopping edges 41 by impeller 27. There they are aligned, until the predetermined number of sheets has been completely stacked after which, as already described, continued stacking is temporarily interrupted by separating fingers 25, 26.

Instead of using a sensor to regulate the elevator, as described above, it is also possible for the user himself to control the elevator. The basis for this regulation will depend on the type of paper used (weight of the paper) and the resulting calculation of its thickness. For example, assuming the weight of the paper to be 80 g/m$^2$, then carrier 2 of apparatus 1 is raised by 1 mm each time the counting device of the apparatus signals the delivery of ten sheets. An apparatus provided with such a system for controlling the elevating mechanism can also be provided with a sensor for measuring the maximum height of the stack to be stapled. It is also possible to combine a known method of direct measurement of the thickness of the paper with a signal from a counting device (not illustrated) and to use this information as a control signal for the described regulation of the elevator of apparatus 1.

Apart from the manner already described, the elevation of apparatus 1 can also be regulated in that regardless of the height of the stack, stepper motor 34 moves apparatus 1 in the direction of arrow "B" into a more raised position or into a completely raised service position. A more raised position (not shown) of apparatus 1 can be advantageous when the intention is to stack paper from a folding device where when folded in the form of a Z, it has billowed up. In the more raised position which is always desired after completion of the stacking procedure, it is easier to remove the billowed stack from the storage container. In this mode of operation, separating fingers 25 and 26 are not used to control stacking, as this could interfere with this process. In the case, separating fingers 25, 26 remain in their upper starting position. In the completely raised service position, apparatus 1 can assume a raised position (not depicted) such that free access to storage container 28 or to stapling devices 38 is rendered possible. In addition to the described regulation of the elevator by means of stepper motor 34 and traction cable 40, apparatus 1 can also be moved by other means of a known type (not illustrated), for example, by means of lever gear, gear wheel, rack gear or the like. Motors 7 and 13 are arranged in the area of carrier 2 which faces shaft 6 and this arrangement makes for a favorable weight distribution, so that the driving force necessary for the regulation of the elevating mechanism can be kept relatively low. Shaft 6 on which carrier 2 of apparatus 1 is pivotably mounted can be simultaneously provided as a drive shaft for impeller 27 (not illustrated), and, in such an instance, will drive traction means 12. In this case, provision must be made that carrier 2 is not displaced toward the longitudinal axis of shaft 6.

We claim:

1. Apparatus for stacking and aligning sheets fed individually into a storage container where they are collected in a pile, the storage container of said apparatus having a tray surface with a front stopping edge for aligning the sheets, and said apparatus having a retaining mechanism placed in the area of the front stopping edge of the tray surface and located above the sheets to be stacked, said retaining mechanism having pivotable separating elements, it being possible, when the stack of sheets is complete, to swing these elements temporarily into the path of the sheets still being fed into the storage container, characterized in that said retaining mechanism (25, 26) and aligning means (27), which guides the sheets to said front stopping edge (41), are arranged on a common carrier (2) which is vertically adjustable with respect to said tray surface (29);

said carrier (2) is connected to and movable by a motor-driven adjusting device (32, 33, 34, 40);

the vertical adjustment said carrier (2) proceeds depending on the height of the stack of the sheets; and said aligning means (27) and said retaining mechanism (25,26) can be moved by said adjusting device (32, 33, 34, 40) into a position dependent on the particular height of the stack of sheets and operational with respect to the upper side of the stack.

2. The stacking apparatus for stacking and aligning sheets fed individually into a storage container where they are collected in a pile, the storage container of said apparatus having a tray surface with a front stopping edge for aligning the sheets, and said apparatus having a retaining mechanism placed in the area of the front stopping edge of the tray surface and located above the sheets to be stacked, said retaining mechanism having pivotable separating elements, it being possible, when the stack of sheets is complete, to swing these elements temporarily into the path of the sheets still being fed into the storage container, characterized in that said retaining mechanism (25, 26) and aligning means (27), which guides the sheets to said front stopping edge (41), are arranged on a common carrier (2) which is vertically adjustable with respect to said tray surface (29);

said carrier (2) is connected to and movable by a motor-driven adjusting device (32, 33, 34, 40); and said aligning means (27) and said retaining mechanism (25, 26) can be moved by said adjusting device (32, 33, 34, 40) into at least one position located above the maximum height of the stack of sheets.

3. The stacking apparatus according to claim 2, characterized in that said carrier (2) is pivotably mounted about a stationary shaft (6) located above the tray surface (29), and in that said aligning means (27) and said retaining mechanism (25, 26) are rotatably and/or pivotably arranged at one free end of said carrier (2) facing said front stopping edge (41).

4. The stacking apparatus according to claim 3, characterized in that said aligning means comprises a pivotably mounted impeller (27) which acts by friction on the upper side of a sheet and delivers a sheet to said front stopping edge (41).

5. The stacking apparatus according to claim 4, characterized in that said separating elements of said retaining mechanism comprises separating fingers (25, 26) which are pivotable from a position in which they extend into the path of the sheets, and form a sloping surface for the sheets and retain the sheets, into a position in which the fingers release the sheets.

6. The stacking apparatus according to claim 5, characterized in that said impeller (27), and said separating fingers (25, 26) are driven by separate motors (7 and 13, respectively).

7. The stacking according to claim 6, characterized in that said separate motors (7 and 13, respectively) are attached to said carrier (2) and engage with said separating fingers (25, 26) and said impeller (27), respectively by traction means (12 and 20, 24, respectively).

8. The stacking apparatus according to claim 7, characterized in that said adjusting device has a traction cable (40) which is attached to said carrier (2) and can be wound up by a separate stepper motor (34).

9. The stacking apparatus according to claim 8, characterized in that said carrier (2) has two arms (3 and 4) which are arranged at a distance from and are rigidly connected to one another, between which said impeller (27) as well as its respective driving motor (7) and respective traction means (12) are positioned.

10. The stacking apparatus according to claim 9, characterized in that at the outer sides of said arms (3 and 4, respectively), said separating fingers (25 and 26, respectively) and said respective traction means (20 and 24, respectively) are positioned, and in that said respective motor driving said separating fingers (13) is fastened on said carrier (2).

11. The stacking apparatus according to claim 10, characterized in that the underside of said carrier (2) facing said tray surface (29) of said storage container (28) is provided with a guide surface (2*a*) which is inclined toward said front stopping edge (41) and which forms a sharp angle (β) to said tray surface (29).

* * * * *